US006650310B2

(12) United States Patent
Yoon

(10) Patent No.: US 6,650,310 B2
(45) Date of Patent: Nov. 18, 2003

(54) LOW-POWER COLUMN DRIVING METHOD FOR LIQUID CRYSTAL DISPLAY

(75) Inventor: Kwang-Ho Yoon, Ichon-shi (KR)

(73) Assignee: Hynix Semiconductor Inc., Ichon-shi (KR)

( * ) Notice: Subject to any disclaimer, the term of this patent is extended or adjusted under 35 U.S.C. 154(b) by 225 days.

(21) Appl. No.: 09/939,786

(22) Filed: Aug. 28, 2001

(65) Prior Publication Data

US 2002/0063668 A1 May 30, 2002

(30) Foreign Application Priority Data

Oct. 25, 2000 (KR) ..... 2000-62927

(51) Int. Cl.[7] ..... G09G 3/36

(52) U.S. Cl. ..... 345/87; 345/90; 345/93; 345/94; 345/98; 345/99; 345/100; 345/204; 345/205; 345/214

(58) Field of Search ..... 345/87, 90, 93, 345/98, 99, 100, 204, 205, 214, 94

(56) References Cited

U.S. PATENT DOCUMENTS 6,201,522 B1 * 3/2001 Erhart et al. ..... 345/96
6,518,947 B1 * 2/2003 Kim ..... 345/100

OTHER PUBLICATIONS

Kwangho Yoon, A Hybird–Level Multi–Phase Charge–Recycler with Reduced Number of External Capacitors for Low–Power LCD Column Drivers, Aug. 28–30, 2000, AP–ASIC 2000 The Second IEEE Asia Pacific Conference on ASICs.

* cited by examiner

*Primary Examiner*—Bupin Shalwala
*Assistant Examiner*—Vincent E. Kovalick
(74) *Attorney, Agent, or Firm*—Jacobson Holman PLLC

(57) ABSTRACT

A hybrid-level charge recycling method for use in implementing low power LCD column drivers. By having external capacitors of the column driver drive the same column lines of the LCD, the need for a polarity reversing circuit is eliminated, and the time necessary for charge recycling, as well as the amount of power consumed, is reduced. As a result, the multi-level recycling operation in column driving IC is made more practical.

3 Claims, 9 Drawing Sheets

LOW-POWER COLUMN DRIVING METHOD FOR LIQUID CRYSTAL DISPLAY

BACKGROUND OF THE INVENTION

1. Field of the Invention

The present invention relates to a column driving method for liquid crystal display devices and, more particularly, a hybrid-level charge recycling method for use in implementing low power LCD column drivers.

2. Description of the Prior Art

With increasing development and use of mobile applications like the digital notebook, the design technique of a low-power LCD column driving integrated circuit (IC) becomes more important. While image quality, EMI reduction, packaging dimensions and weight are also important issues in LCD driving devices, of particular importance are power dissipation and the number of external components needed.

FIG. 1 shows a block diagram of a conventional column driver.

The conventional column driver comprises a digital logic unit 10, a digital-analog converter (DAC) 12, an output driving unit 14, and a charge recycling unit 16 in order to drive the an LCD panel 18.

Digital image information, such as red (R), green (G) and blue (B) data, is inputted to the digital logic unit 10, in order to drive the DAC 12. An analog voltage generated by the DAC 12 is inputted to the output driving unit 14. At this time, the output driving unit 14 drives column lines having relatively large capacitance.

The power consumption of the output driving unit 14 for driving the column lines is highest among the elements comprised in the column driver. The dynamic power consumption can be expressed as equation (1).

$$P_{dynamic} = V_{dd} \times I_{avg} = \frac{V_{dd} \times N \times C_{load} \times V_{swing} \times F_{row}}{2} \quad (1)$$

In equation 1, the 'Vdd' is power supply voltage, '$I_{avg}$' is average current from the power supplier, 'N' is the number of outputs in the driver, '$C_{load}$' is capacitance of the respective column line, '$F_{row}$' is row frequency or horizontal frequency, and '$V_{swing}$' is the average output voltage swing.

As shown in FIG. 1, the column driver comprises the charge recycling unit 16 for charge conservation in order to reduce the power consumption. The charge conservation method employed in the charge recycling unit 16 will be described referring to FIGS. 2A and 2B.

FIG. 2A shows the circuit of the conventional column driver adopting a 1-level/3-phase charge recycling method.

As shown in FIG. 2A, the conventional column driver comprises an external capacitor $C_{EXT}$ and a plurality of switches SW1 to SWn for switching the column lines 01 to 0n. The switches SW1 to SWn respond to a separating phase (isolation), a charge recycling phase (ext) and a driving phase (drv).

FIG. 2B shows the voltage waveforms of the column driver outputs corresponding to the separating phase, the charge recycling phase and the driving phase.

The operation of the conventional column driver adopting the 1-level/3-phase charge recycling method will be described in detail referring to FIGS. 2A and 2B.

The conventional column driver comprising the external capacitor $C_{EXT}$ is operated in three phases.

In the first phase, i.e., in the separating phase, the column lines 01 to 0n are separated from the output driving unit (not shown in FIG. 2A). In the second phase, i.e., in the charge recycling phase, the column lines 01 to 0n are connected to the external capacitor $C_{EXT}$ whereby all the charges from the column lines 01 to 0n are stored in the external capacitor $C_{EXT}$; subsequently all the column lines 01 to 0n are equalized to an average voltage '$V_{dd}/2$'. In the third phase, i.e., in the driving phase, all the column lines 01 to 0n are connected to the output driving unit 14.

According to the method outlined above, the average voltage swing of the output driver may be reduced from '$V_{swing}$' to '$V_{dd}/2$'. Thereby, it is possible to reduce power consumption of the column driver by 50% compared with the column driver which does not contain a charge recycling unit.

The 1-level/3-phase charge recycling method can be extended to a multi-level/multi-phase method to improve power efficiency, for example, a conventional column driver may adopt a 3-level/5-phase charge recycling method.

FIG. 3A shows the circuit of the conventional column driver adopting the 3-level/5-phase charge recycling method, and FIG. 3B shows the voltage waveforms of the column driver outputs corresponding to the separating phase, the charge recycling phase and the driving phase.

As shown in FIG. 3A, the conventional column driver adopting the 3-level/5-phase charge recycling method comprises three external capacitors for respective charge recycling phases.

All the column lines of the column driver adopting the 3-level/5-phase charge recycling method are not equalized to the same voltage. That is, the column lines with positive voltage are equalized to one voltage and the column lines with negative voltage are equalized to another voltage. The 3-level/5-phase charge recycling method can be extended to a higher level charge recycling method such as a 5-level/7-phase or a 7-level/9-phase, in a similar way. FIG. 3C shows the timing diagram of the column driver shown in FIG. 3A. However, conventional multi-level/multi-phase methods have the problem of timing and the necessity of the polarity reversing circuit that needs an extra control signal. The polarity reversing circuit shown in FIG. 3A is required since the charge recycled from odd lines is used to drive even lines and vice versa, as shown in the timing diagram of FIG. 3B.

SUMMARY OF THE INVENTION

It is, therefore, an object of the present invention to provide a column driving method capable of reducing the charge recycling time as well as power consumption.

It is, therefore, another object of the present invention to provide a column driving method that does not require polarity reversing circuits.

In accordance with an aspect of the present invention, there is provided a column driving method for the column driver of an LCD device comprising an LCD panel, a plurality of column lines connected to the LCD panel, an output driving unit for driving the column lines, and a charge storage unit for charge recycling the column lines, the method comprising the steps of separating the column lines from the output driving unit; transferring charges from the column lines to the charge storage unit; equalizing the voltage of the column lines; driving the column lines without using the charges stored in the charge storage unit;

separating the column lines from the output driving unit; equalizing the voltage of the column lines; and driving the column lines by using the charges stored in the charge storage unit.

In accordance with another aspect of the present invention, there is provided a column driving method for the column driver of an LCD device comprising an LCD panel, a plurality of column lines connected to the LCD panel, an output driving unit having a first and second capacitor for driving the column lines, a charge storage unit having a first and second capacitor for charge recycling the column lines, and an equalizing unit connected to the column lines, the method comprising the steps of separating the column lines from the output driving unit; transferring charges from the column lines to the charge storage unit; equalizing the column lines by connecting the column lines to the equalizing unit; driving the column lines without using the charges stored in the first capacitor and second capacitor; separating the column lines from the output driving unit; equalizing the column lines by connecting the column lines to the equalizing unit; and driving the column lines using the charges stored in the first and second capacitors.

In accordance with further another aspect of the present invention, there is provided a column driving method for the column driver of an LCD device comprising an LCD panel, a plurality of odd column lines connected to the LCD panel, a plurality of even column lines connected to the LCD panel, an output driving unit for driving the column lines, a first capacitor connected to the odd column lines, a second capacitor connected to the even column lines, and a third capacitor connected to the odd column lines and the even column lines as an equalizing unit, the method comprising the steps of separating the odd column lines and the even column lines from the output driving unit; transferring charges from the odd column lines to the first capacitor and transferring charges from the even column lines to the second capacitor; connecting the odd column lines and the even column lines to the third capacitor for equalizing; driving the odd column lines and the even column lines without using the charges stored in the first capacitor and the second capacitor; separating the odd column lines and the even column lines from the output driving unit; connecting the odd column lines and the even column lines to the third capacitor for equalizing; and driving the odd column lines by using the charges stored in the first capacitor and driving the even column lines by using the charges stored in the second capacitor.

BRIEF DESCRIPTION OF THE DRAWINGS

The above and other objects and features of the present invention will become apparent from the following description of the preferred embodiments given in conjunction with the accompanying drawings, in which.

DETAILED DESCRIPTION OF THE PREFERRED EMBODIMENTS

Hereinafter, a column driver driving method according to embodiments of the present invention will be described in detail referring to the accompanying drawings.

To reduce the charge recycling time and to eliminate the polarity reversing circuit, the present invention is directed to a column driving method adopting a hybrid-level/multi-phase method. In the hybrid-level/multi-phase recycling method, the 1-level/3-phase method and the 3-level/5-phase method are interleaved resulting in 3-level/4-phase operation.

Figure 1:
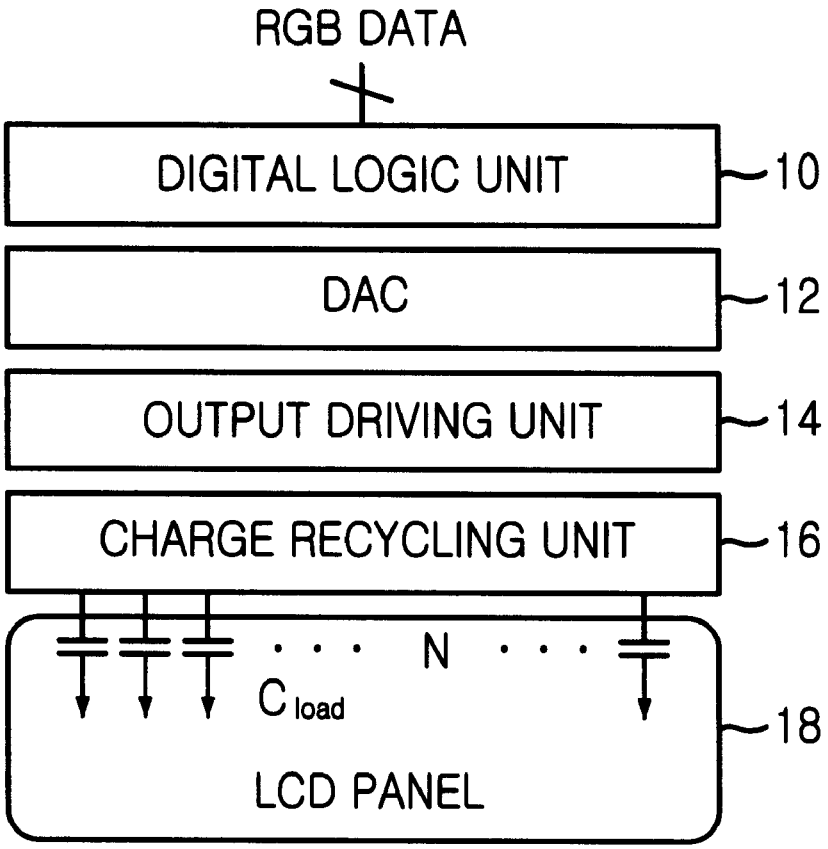
FIG. 1 (PRIOR ART)
FIG. 1 shows a block diagram of a conventional column driver.
Figure 2A:
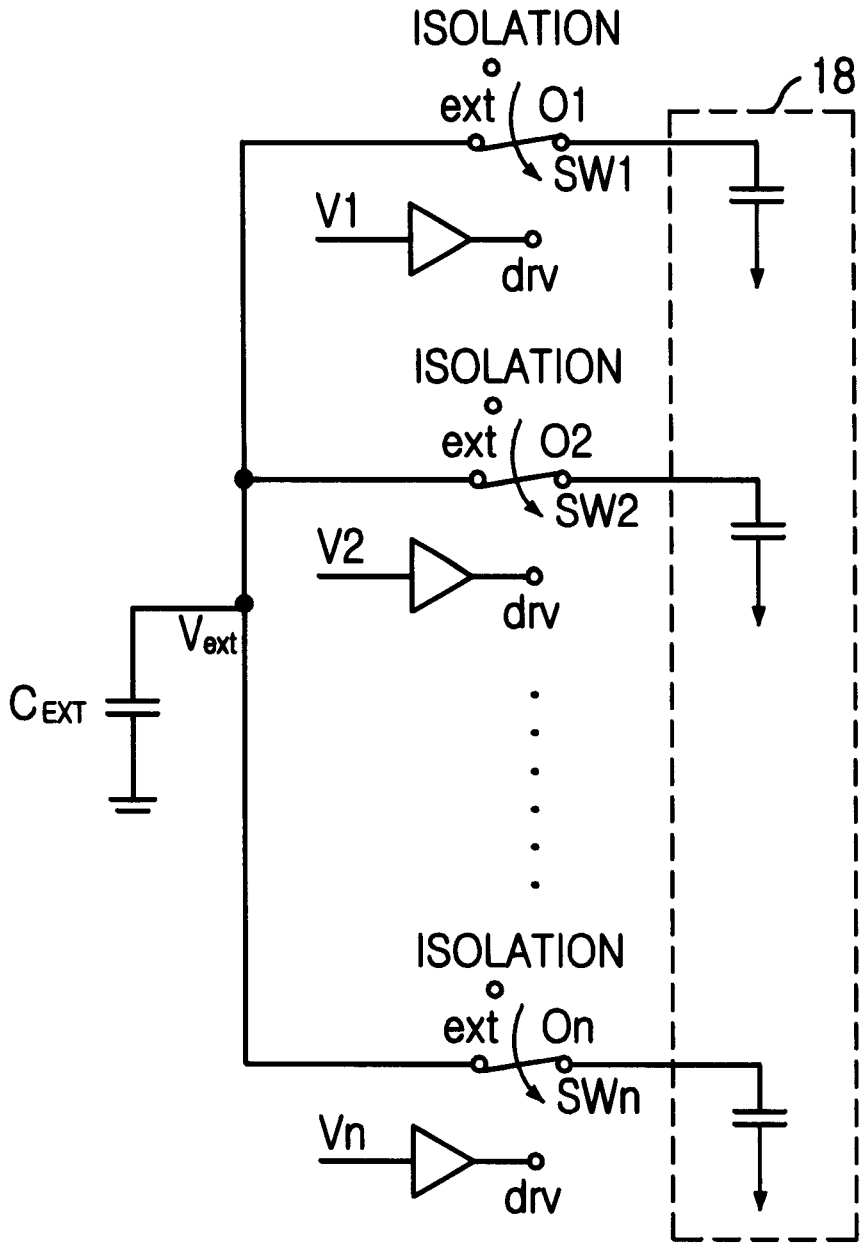
FIG. 2A (PRIOR ART)
FIG. 2A shows the circuit of the conventional column driver adopting a 1-level/3-phase charge recycling method.
Figure 2B:
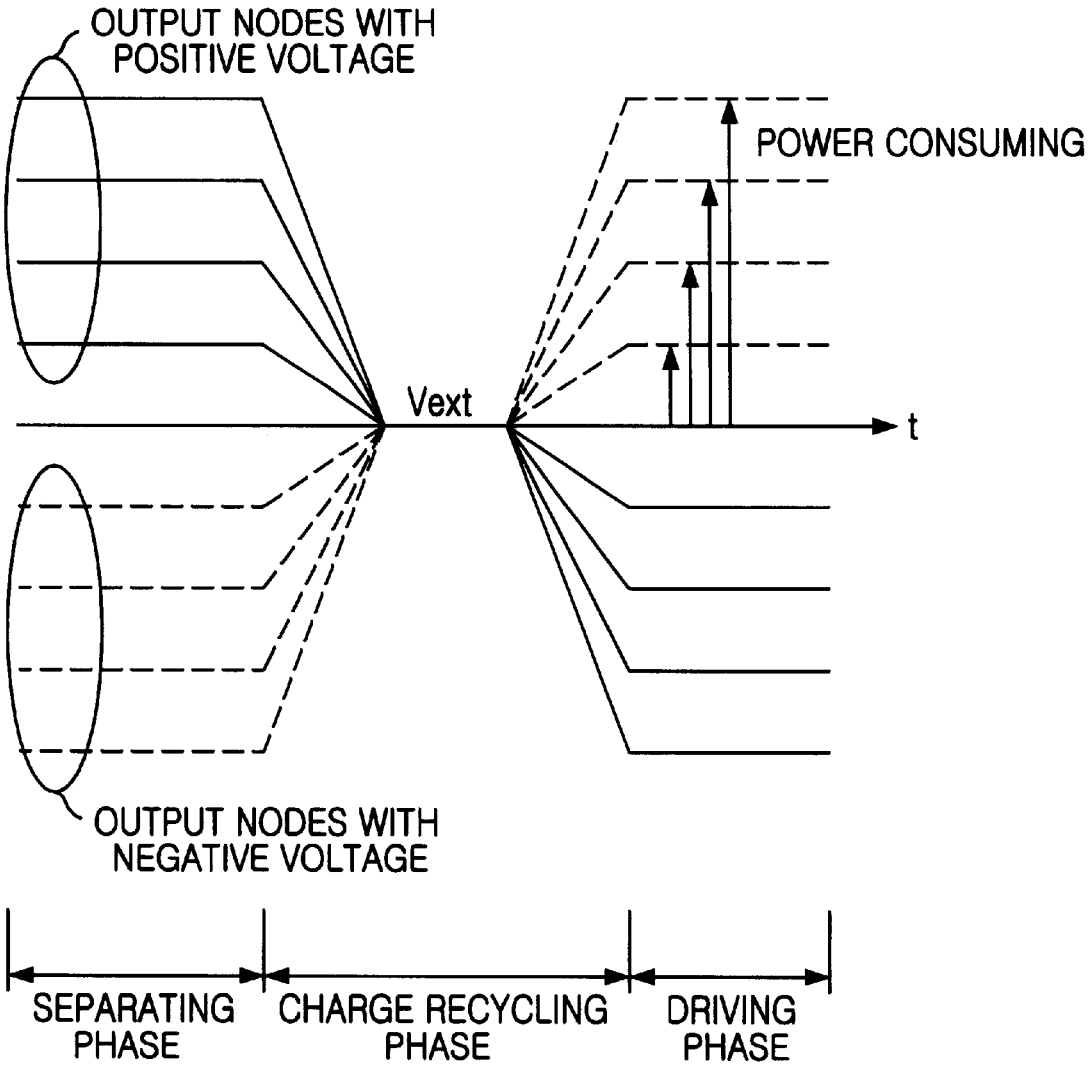
FIG. 2B (PRIOR ART)
FIG. 2B shows the voltage waveforms of the column driver outputs according to the conventional column driving method.
Figure 3A:
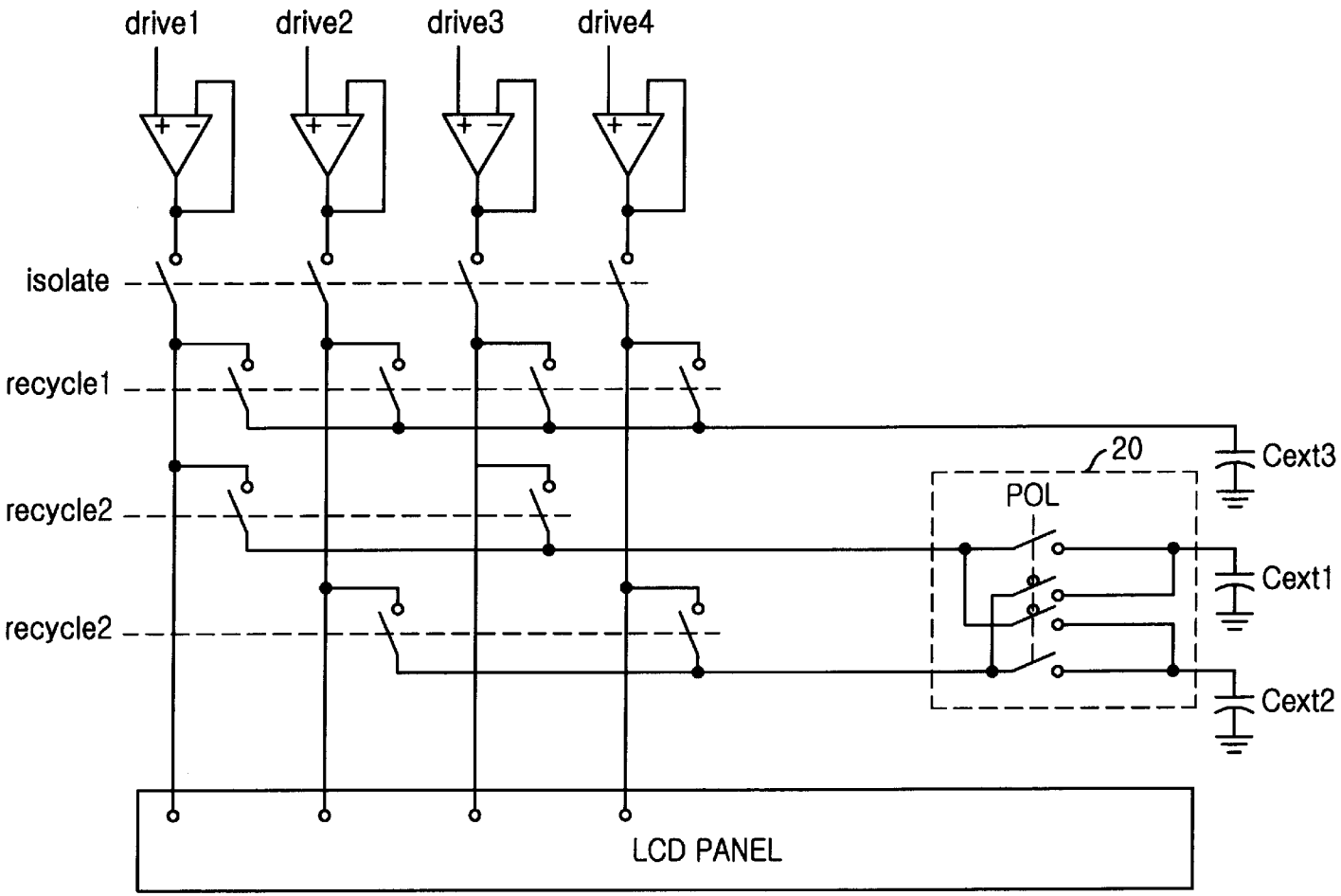
FIG. 3A (PRIOR ART)
FIG. 3A shows the circuit of the conventional column driver adopting a 3-level/5-phase charge recycling method.
Figure 3B:
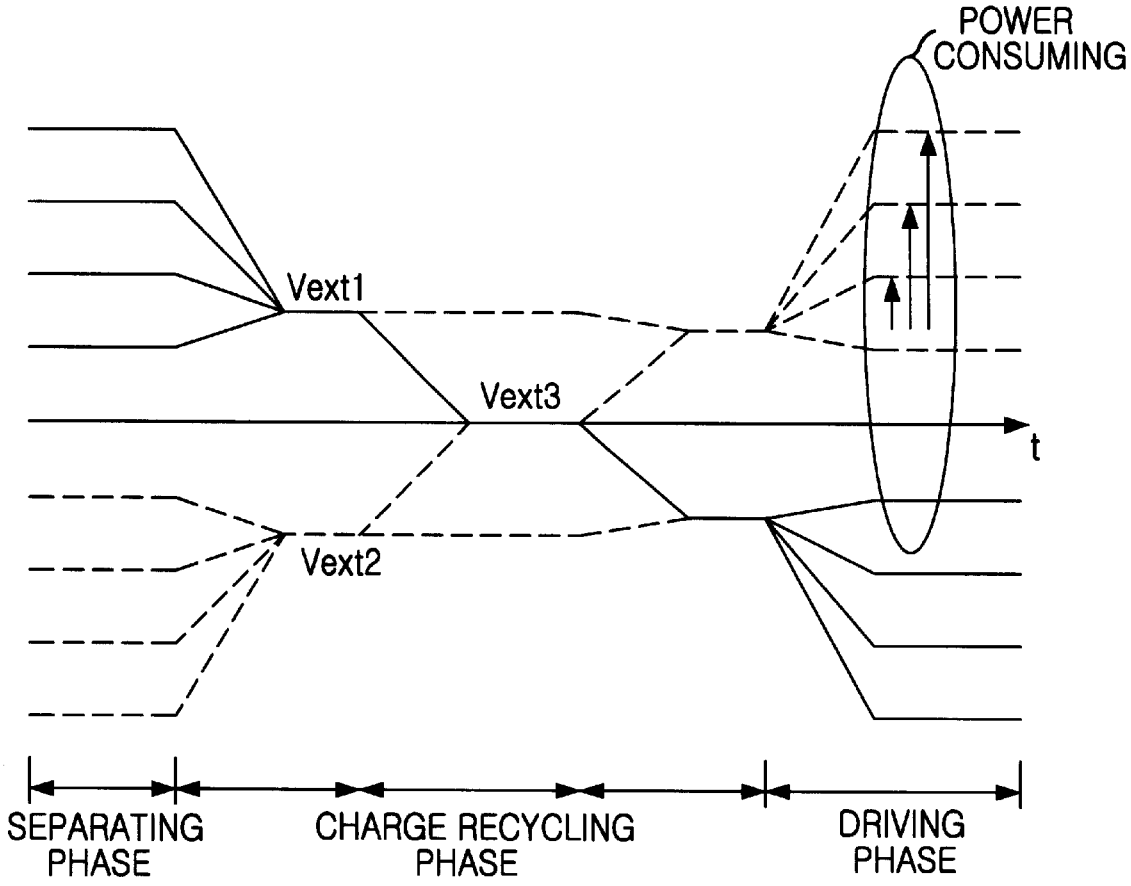
FIG. 3B (PRIOR ART)
FIG. 3B shows the voltage waveforms of the column driver outputs corresponding to the separating phase, the charge recycling phase and the driving phase.
Figure 3C:
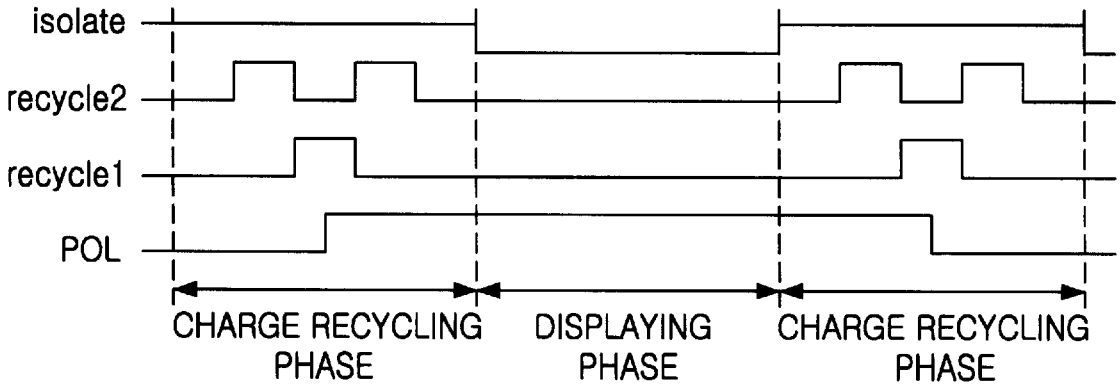
FIG. 3C (PRIOR ART)
FIG. 3C shows the timing diagram of the column driver shown in FIG. 3A.
Figure 4:
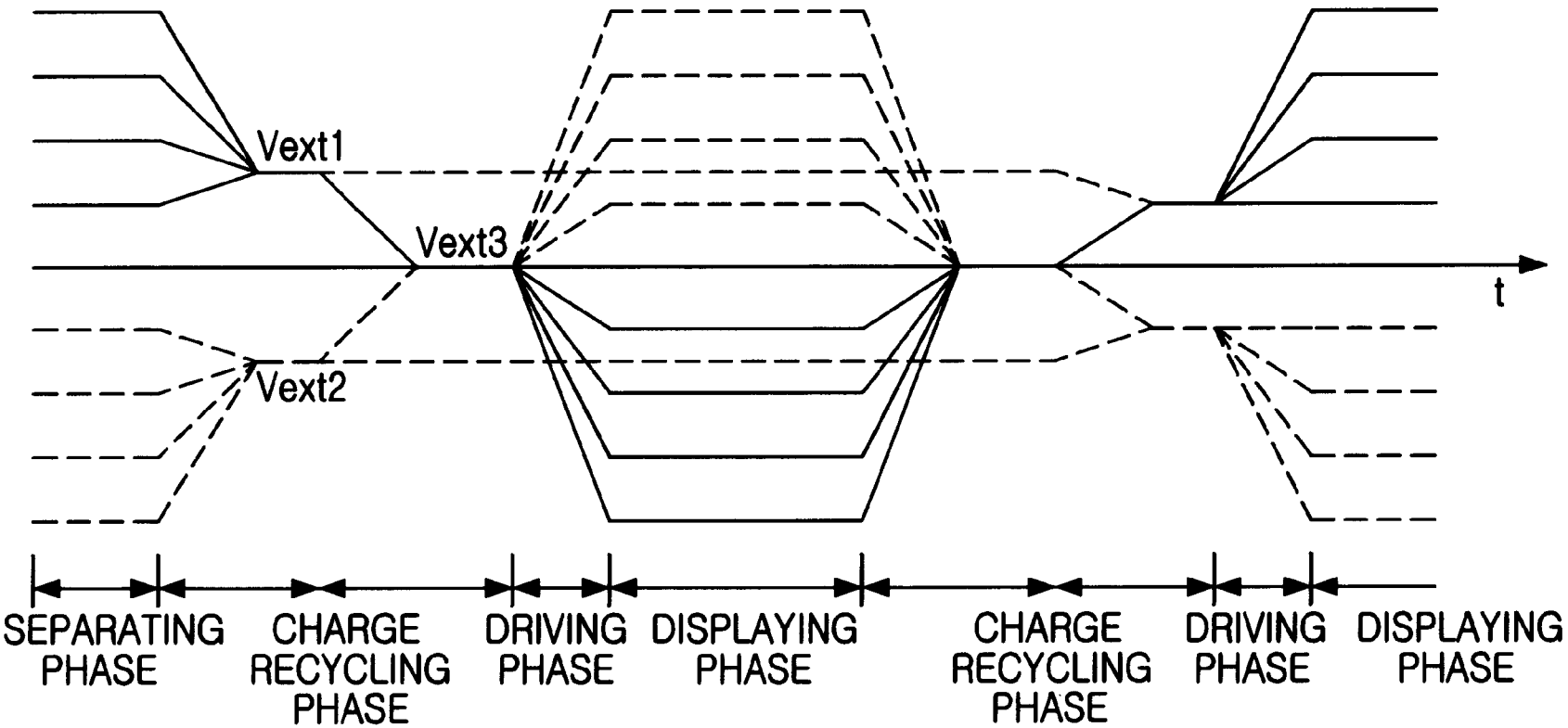
FIG. 4 shows the voltage waveforms of the column driver outputs according to the 3-level/4-phase column driving method of the present invention.
Figure 5A:
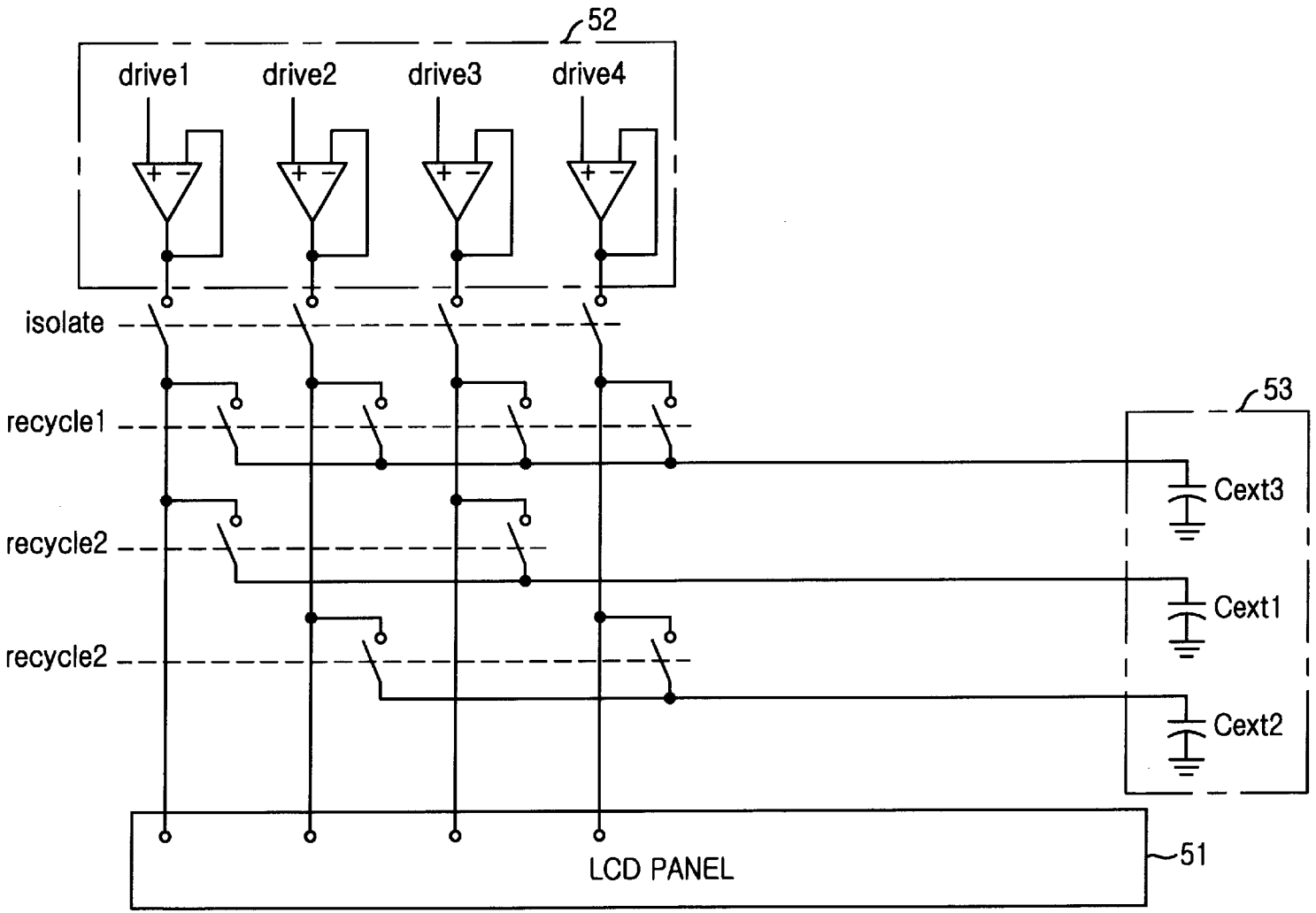
FIG. 5A shows the circuit of the column driver adopting the 3-level/4-phase charge recycling method according to the present invention.
Figure 5B:
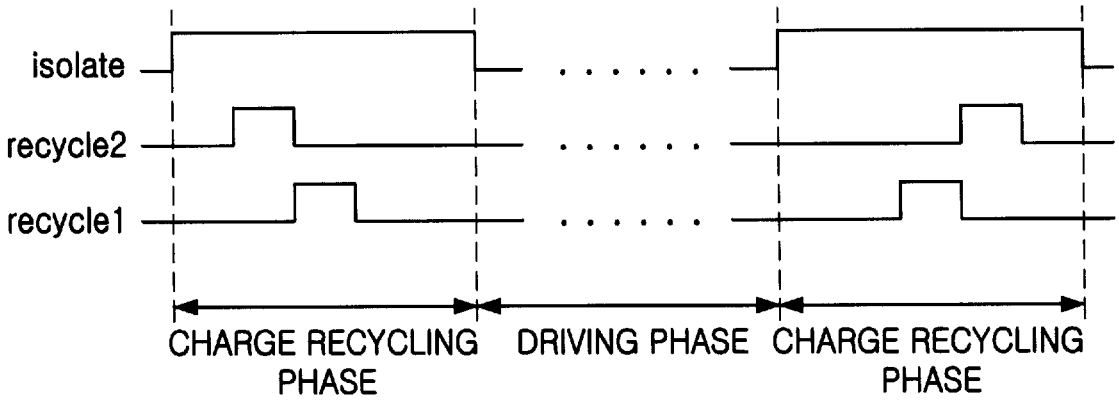
FIG. 5B shows the timing diagram of the column driver shown in FIG. 5A.

FIG. 4 shows the voltage waveforms of the column driver outputs corresponding to the 3-level/4-phase column driving method of the present invention. FIG. 5A shows the circuit of the column driver adopting the 3-level/4-phase charge recycling method according to the present invention. FIG. 5B shows the timing diagram of the column driver outputs of the circuit shown in FIG. 5A, corresponding to the 3-level/4-phase charge recycling method according to the present invention.

As shown in FIG. 5A, the column driving method according to the present invention is applied to the column driver of an LCD device comprising an LCD panel 51, a plurality of column lines connected to the LCD panel 51, an output driving unit 52 for driving the column lines, and a charge storage unit 53 for charge recycling the column lines.

The external charge storage unit 53 may comprise three capacitors $C_{ext1}$, $C_{ext2}$, and $C_{ext3}$ as shown in FIG. 5A. While the multi-level multi-phase recycling method has an advantage in reducing power consumption, in real implementation the number of external capacitors may cause a problem due to increased area required for such capacitors. Thus reducing the number of external capacitors may be a more important consideration than reducing the power dissipation. Since the node voltages on $C_{ext1}$ and $C_{ext2}$ move differentially with reference to some common voltage, the two external capacitors $C_{ext1}$ and $C_{ext2}$ can be merged into one floating capacitor $C_{diff}$. Therefore, it is possible to form the size of the floating capacitor $C_{diff}$ to a size half that of the external capacitor $C_{ext1}$ or $C_{ext2}$.

Contrary to the conventional multi-level/multi-phase method, the external capacitors of the column driver according to the present invention always drive the same column lines of the LCD. Therefore, the polarity reversing circuit can be omitted, as shown in FIG. 5A and it is also possible to simplify the timing and to reduce the chip size and power consumption.

Referring to FIGS. 4, 5A and 5B, the column driving method according to the present invention will be described in detail.

At a first step, the column lines are separated from the output driving unit 52. At a second step, the charges stored in the column lines are transferred to the first and second capacitors of the charge storage unit 53. That is, with recycle2 switch on, the charges stored in the odd column lines are transferred to the external capacitor $C_{ext1}$ and the charges stored in the even column lines are transferred to external capacitor $Cext_2$. At a third step, with recycle1 switch on, all column lines are connected to $C_{ext3}$ which acts as an equalizing unit and the voltages of all the column lines are equalized. At a fourth step, the column lines are driven without using the charges stored in the charge storage unit 53. At a fifth step, all column lines are separated again. At a sixth step, all the column lines are equalized to the same voltage with recycle1 switch on. At a seventh step, the charges stored in the external capacitors $C_{ext1}$ and $C_{ext2}$ are recycled. At an eighth step, the column lines are driven using the charges stored in the charge storage unit. These processes are repeated from the first step.

Consequently, it is possible to improve total timing by reducing the recycling time, that is, the timing may be reduced by 1-phase by driving the column driver configured to a 3-level/5-phase method with the 3-level/4-phase method. Also it is possible to obtain a level of power consumption that is lower than that which can be obtained by the 1-level/3-phase method and higher than that which can be obtained by the 3-level/5-phase method.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A column driving method for a column driver of an LCD device comprising an LCD panel, a plurality of column lines connected to the LCD panel, an output driving unit for driving the column lines, and a charge storage unit for charge recycling the column lines, the method comprising the steps of:

separating the column lines from the output driving unit;

transferring charges from the column lines to the charge storage unit;

equalizing the voltage of the column lines;

driving the column lines without using the charges stored in the charge storage unit;

separating the column lines from the output driving unit;

equalizing the voltage of the column lines; and driving the column lines by using the charges stored in the charge storage unit.

2. A column driving method for a column driver of an LCD device comprising an LCD panel, a plurality of column lines connected to the LCD panel, an output driving unit for driving the column lines, a charge storage unit having first and second capacitors for charge recycling the column lines, and an equalizing unit connected to the column lines, the method comprising the steps of:

separating the column lines from the output driving unit;

transferring charges from the column lines to the charge storage unit;

equalizing the column lines by connecting the column lines to the equalizing unit;

driving the column lines without using the charges stored in the first capacitor and second capacitor;

separating the column lines from the output driving unit;

equalizing the column lines by connecting the column lines to the equalizing unit; and driving the column lines using the charges stored in the first and second capacitors.

3. A column driving method for a column driver of an LCD device comprising an LCD panel, a plurality of odd column lines connected to the LCD panel, a plurality of even column lines connected to the LCD panel, an output driving unit for driving the column lines, a first capacitor connected to the odd column lines, a second capacitor connected to the even column lines, and a third capacitor connected to the odd column lines and the even column lines, the method comprising the steps of:

separating the odd column lines and the even column lines from the output driving unit;

transferring charges from the odd column lines to the first capacitor and transferring charges from the even column lines to the second capacitor;

connecting the odd column lines and the even column lines to the third capacitor for equalizing;

driving the odd column lines and the even column lines without using the charges stored in the first capacitor and second capacitor;

separating the odd column lines and the even column lines from the output driving unit;

connecting the odd column lines and the even column lines to the third capacitor for equalizing; and driving the odd column lines by using the charges stored in the first capacitor and driving the even column lines by using the charges stored in the second capacitor.

* * * * *